United States Patent [19]

Cuschera

[11] 4,006,498

[45] Feb. 8, 1977

[54] ADAPTER FOR BATHTUB DRAIN

[76] Inventor: Casper Cuschera, 31650 Medinah St., Hayward, Calif. 94543

[22] Filed: Sept. 2, 1975

[21] Appl. No.: 609,747

[52] U.S. Cl. ..... 4/191; 4/286; 285/323; 403/370; 403/374

[51] Int. Cl.[2] ..... A47K 1/14; F16B 2/14

[58] Field of Search ..... 4/204, 286, 287, 293, 4/295, 252 R, 191; 277/110, 112; 285/322, 323, 216, 217; 403/367, 370, 374

[56] References Cited

UNITED STATES PATENTS

| | | | |
|---|---|---|---|
| 2,849,245 | 8/1958 | Baker | 285/323 X |
| 3,311,391 | 3/1967 | Harrell | 285/323 X |
| 3,314,085 | 4/1967 | Minella | 4/287 |
| 3,379,459 | 4/1968 | Smid | 285/216 |
| 3,668,718 | 6/1972 | Cuschera | 4/288 |
| 3,771,177 | 11/1973 | Rogers et al. | 4/287 |

*Primary Examiner*—Richard E. Aegerter
*Assistant Examiner*—Stuart S. Levy
*Attorney, Agent, or Firm*—Harris Zimmerman

[57] ABSTRACT

An adapter for installing a replacement drain valve in an existing drain comprises a cylindrical valve adapter insertable in the drain. The interior of the adapter is threaded, and the exterior is tapered upwardly. A similarly tapered split ring is disposed between the adapter and the drain. An externally threaded driving member is received in the adapter, and includes an outwardly extending flange which impinges on the upper end of the split ring. The drive member wedges the split ring between the drain and the adapter, securing the latter in the drain. The adapter includes a spider in the lower end thereof which receives and secures the replacement valve.

4 Claims, 4 Drawing Figures

ADAPTER FOR BATHTUB DRAIN

BACKGROUND OF THE INVENTION

Drains which are selectively closed by mechanically operated remotely actuated valves, such as those commonly used in bathtubs, sinks, and the like, are notorious for the operational and maintenance problems which they incur over a period of years. These valves are often operated by levers or similar mechanical linkages which are subject to failures due to wear, corrosion, and accumulated dust and dirt. Whatever the mechanical linkage, it must pass beneath the tub or drain, and is therefor nearly impossible to repair. Furthermore, these remotely actuated valves often become maladjusted and leak, requiring constant refilling of the sink or tub.

To repair these broken or maladjusted drain valves, replacement drain valves have been developed which may be secured in the old drain, and which embody both the drain valve and the mechanism for actuating it. Although these replacement devices are effective and easily serviced, they are often difficult to install. Typically the existing drain body is provided with a smooth bore in which the replacement valve is easily seated but difficult to secure. Often the drain body requires modification, or adhesives must be used. In any case, the labor required to install the new valve is often more costly than the valve itself.

SUMMARY OF THE INVENTION

The present invention generally comprises an adapter for facilitating the installation of a replacement drain valve in an existing drain. It includes a generally cylindrical member which is threaded in its interior bore, and is upwardly tapered on the exterior. The cylindrical member is inserted in the existing drain body, and a split ring having a downwardly extending wedge shape is inserted between the drain body and the tapered exterior of the cylindrical member. The cylindrical member is provided with a spider at the lower end thereof which includes a threaded hole for securing the replacement drain valve.

The invention also includes an externally threaded hollow tubular drive member which is received in the cylindrical member. The drive member includes an outwardly extending flange at the upper end thereof which impinges on the upper end of the split ring as the drive member is threaded into the cylindrical member. The wedge is thus driven downwardly to compressively secure the adapter in the existing drain body.

It is then possible quickly to install a new drain valve within the adapter, secured to the spider thereof. Waste water may then drain through the bore of the drive member and the spider, or may be retained by the new valve sealing to the upper surface of the drive member. It may be appreciated that the adapter of the present invention permits a new valve installation which is quicker and cheaper than prior art methods which require modification of the existing drain. Furthermore, the new drain valve and the adapter are both easily removable for maintenance and repair.

THE DRAWING

DESCRIPTION OF THE PREFERRED EMBODIMENT

Figure 1:
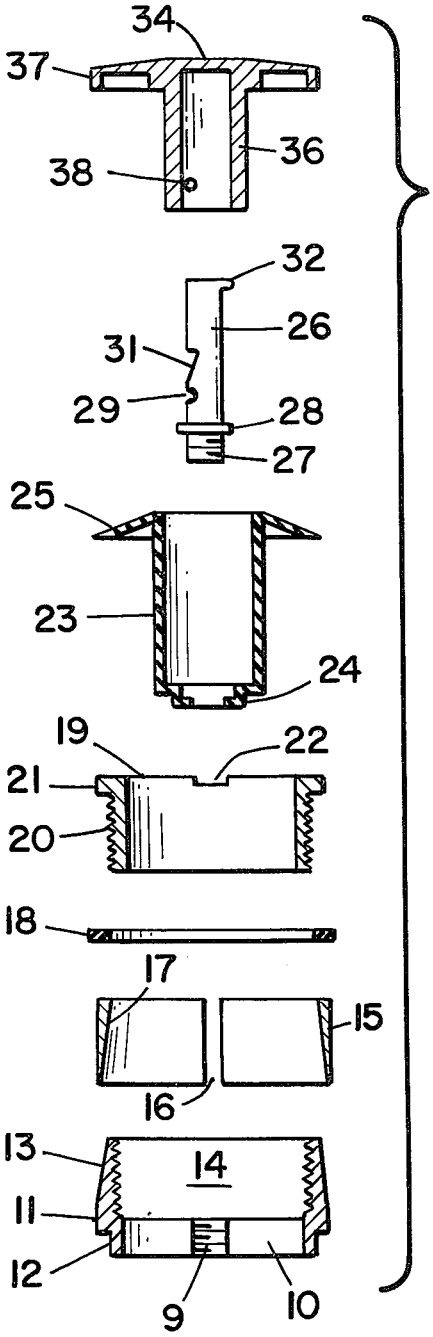
FIG. 1 is an exploded view of the components of the present invention.

The present invention relates to a device for facilitating the installation of a replacement drain valve in an existing drain. With reference to the accompanying Figures, and in particular FIG. 1, the present invention includes a cylindrical member 11 which is provided with a narrow shoulder 12 at the lower end thereof. The exterior surface 13 of the member is tapered upwardly and inwardly for reasons which will become evident in the following description. The hollow inner bore of the member 11 is provided with a spider 10 at the lower end thereof, and is internally threaded from the spider to the upper end thereof.

The invention also includes a split ring 15, which comprises an annular ring having a single gap 16 extending vertically therethrough. The exterior surface of the ring 15 is parallel to the axis of the ring, and the interior surface is tapered upwardly and inwardly at approximately the same angle as the surface 13 of member 11 to define a wedge shaped ring cross-section. Disposed above the ring 15 and adapted to rest therein is an annular washer 18.

A hollow tubular drive member 19 is also provided, and has external threads 20 to be received within the bore of the member 11. Extending radially outwardly from the member 19 at the upper end thereof is a flange 21. The upper surface of the flange is provided with slots 22 for engagement with a spanner wrench, as is known in the art.

The valve device shown and described herein forms no part of the present invention, and is included for exemplary purposes only to show the manner in which a new or replacement valve may be secured to the adapter of the present invention. The valve includes a valve stem 26 which is threaded at the lower end portion 27 below an outwardly extending flange 28. The threaded portion is adapted to engage the threaded hole 9 in the spider 10 of the cylindrical member 11.

The stem 26 is provided with a generally rectangular cross-section, with an obliquely sloping slot 31 in one surface thereof. Directly subjacent to the slot and parallel thereto is a groove 29. The valve includes a resilient sealing boot 23 which comprises a generally tubular portion and a resilient sealing skirt 25 extending from the upper end thereof. The lower end of the boot is provided with a reduced diameter annular shoulder 24.

The valve is also provided with an actuator 34, which includes a hollow tubular portion 36 with a disc-like member 37 secured to the upper end thereof. Extending through the bore of the tubular portion 36 is a pin 38 which is adapted to engage the slot 31 and groove 29 of the valve stem 26.

Figure 2:
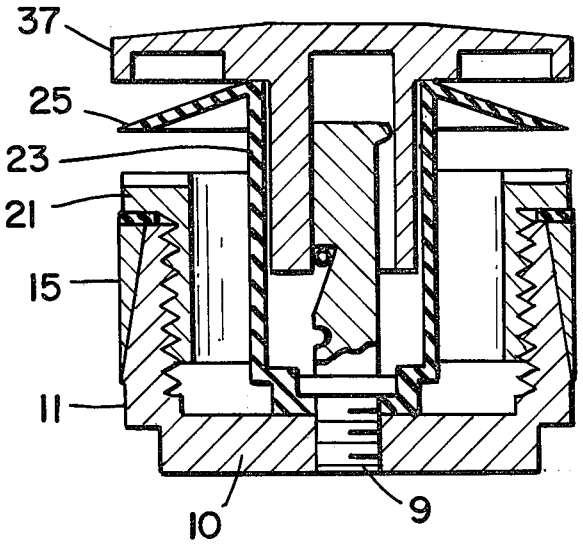
FIG. 2 is a cross-sectional elevation of the present invention with the drain valve in the open position.
Figure 3:
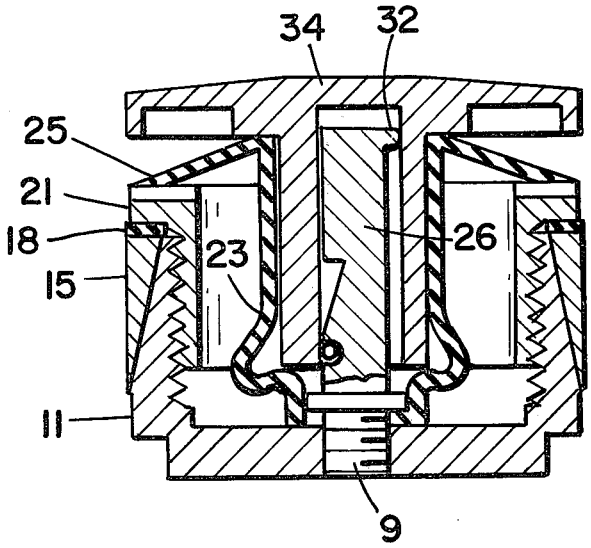
FIG. 3 is a cross-sectional elevation of the present invention with the drain valve in the closed position.
Figure 4:
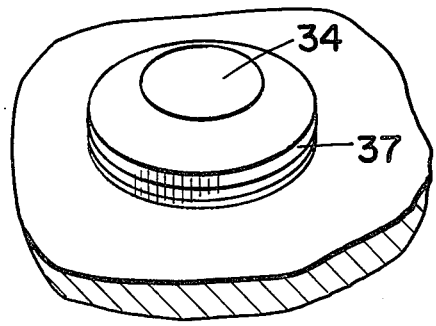
FIG. 4 is a perspective view of the present invention with the drain valve in the closed position.

The use of the present invention with a new or replacement drain valve is shown to advantage in FIGS. 2 and 3. The cylindrical member 11 is inserted in an existing drain body, with the split ring 15 secured loosely thereabout. The washer 18 is then placed on the driving member 19, and the driving member is threadedly engaged in the cylindrical member 11. As the flange 21 of the driving member impinges on the washer and thus the upper edge of the split ring, the ring 15 is driven downward into the gap formed between the tapered surface 13 and the interior bore of the existing drain. When the driving member is tightened down with a spanner wrench engaging the slots 22, the wedging engagement of the split ring secures the cylindrical member rigidly in place in the drain body.

The portion 27 of the valve stem is then extended through the annular shoulder 24 of the sealing boot and threadedly secured in the hole 9 of the adapter. The actuator 34 is then inserted over the valve stem and into the sealing boot to complete the installation of the new valve device. The installation is thus quick and easy, requiring no permanent modification of the drain itself. Furthermore, the new valve and adapter may easily be removed for servicing of the drain or maintenance of the valve.

The sealing skirt of the boot 23 acts to seal the opening of the drain, and the tubular portion of the boot acts as a resilient spring to bias the skirt in the open flow position. The slot 31 and groove 29 act as detents for the pin 38 of the actuator, to maintain the valve in the open position (FIG. 2) or closed position (FIG. 3). A full description of the valve device itself may be found in U.S. Pat. No. 3,771,177, issued on Nov. 13, 1973, to Chester A. Rogers et al.

It may be appreciated that the cylindrical member 11 may be provided with internal threads, bayonet mounts, or detents to secure various other forms of replacement valve devices.

I claim:

1. An adapter for securing a valve device in a drain, comprising a cylindrical member adapted to be disposed in said drain, said cylindrical member including an exterior surface portion tapering inwardly and upwardly; an annular wedge disposed about said cylindrical member; drive means secured to said adapter and variably spaced with respect to said cylindrical member to drive said wedge to engage said tapered surface portion and the interior surface of said drain; and securance means for securing a valve device to said adapter, said cylindrical member including a central bore having an internally theaded portion, and said drive means including a tubular member provided with external threads adapted to be received in said central bore, said tubular member including a flange extending radially from the upper end thereof and beyond said cylindrical member for engaging and driving said wedge in an axial direction into engagement with said tapered surface portion and said interior surface of said drain.

2. The adapter of claim 1, wherein said securance means comprises a spider secured to the lower end of said cylindrical member.

3. The adapter of claim 1, wherein said wedge includes a split ring having a cross-sectional wedge configuration.

4. The adapter of claim 3, wherein the exterior surface of said ring is parallel to the axis thereof, and the interior surface of said ring extends obliquely upwardly and inwardly.

* * * * *